United States Patent [19]

Falxa et al.

[11] 4,259,438

[45] Mar. 31, 1981

[54] METHOD FOR PREPARING PHOTOSENSITIVE SILVER HALIDE EMULSIONS

[75] Inventors: Martin L. Falxa, Cambridge; Kenneth J. Meara, Burlington, both of Mass.

[73] Assignee: Polaroid Corporation, Cambridge, Mass.

[21] Appl. No.: 921,438

[22] Filed: Jul. 3, 1978

[51] Int. Cl.[3] ..... G03C 1/02

[52] U.S. Cl. ..... 430/567; 156/600; 156/603; 430/569

[58] Field of Search ..... 96/94 R, 94 BF, 64, 96/107, 125, 108, 67; 430/567, 569, 570; 156/600, 603

[56] References Cited

U.S. PATENT DOCUMENTS

| | | | |
|---|---|---|---|
| 2,005,837 | 6/1935 | Ahrens | 430/569 |
| 2,184,013 | 12/1939 | Leermakers | 430/406 |
| 2,576,850 | 11/1951 | Murray | 260/30.4 R |
| 3,598,593 | 8/1971 | Klinger | 430/567 |
| 3,647,458 | 3/1972 | Tagliafico et al. | 430/596 |

OTHER PUBLICATIONS

G. F. Duffin, *Photographic Emulsion Chemistry*, p. 61, 1966.

*Primary Examiner*—Edward C. Kimlin
*Attorney, Agent, or Firm*—Philip G. Kiely

[57] ABSTRACT

The present invention is directed to a method for preparing a photosensitive silver halide emulsion comprising silver halide grains prepared by simultaneously introducing a solution of ammoniacal silver nitrate and a solution of an ammonium halide into a solution of gelatin and a second ammonium halide. The invention is also directed to photographic elements employing such silver halide emulsions.

12 Claims, No Drawings

METHOD FOR PREPARING PHOTOSENSITIVE SILVER HALIDE EMULSIONS

BACKGROUND OF THE INVENTION

It is known in the art to prepare photosensitive silver halide grains in the presence of ammonia. For example, on page 61 of *Photographic Emulsion Chemistry,* G. F. Duffin, *The Focal Press,* New York, 1966, it is stated that ammonia is generally introduced into the silver halide precipitation procedure either in the silver solution or alternatively in the halide gelatin solution and/or in the added halide in a double jet procedure. Examples of such procedures also appear in the patent art.

U.S. Pat. No. 2,005,837 discloses a method in which comprises introducing into an ammoniacal silver nitrate solution, a solution of gelatin, ammonium bromide and potassium iodide. Subsequent to the initial addition, after about a half an hour elapsed time, is added an additional solution of ammonium bromide and potassium iodide.

U.S. Pat. No. 2,184,013 is directed to the method which comprises mixing solutions of potassium bromide, potassium iodide, gelatin and ammonium hydroxide with an ammoniacal silver nitrate solution.

U.S. Pat. No. 2,576,850 describes the process of simultaneously adding to a solution of completely hydrolyzed ethylene/vinylacetate, a first solution of ammoniacal silver nitrate containing sodium dodecyl sulfate and a second solution of ammonium bromide, potassium iodide and sodium dodecyl sulfate.

U.S. Pat. No. 3,598,593 discloses the preparation of ammoniacal silver halide emulsions employing a double jet procedure wherein ammonium bromide and silver nitrate are simultaneously jetted into a solution of potassium bromide and gelatin.

U.S. Pat. No. 3,647,458 is directed to a method for the preparation of direct positive emulsions which comprises the steps of adding to a solution of gelatin, ammonium bromide, potassium iodide and glycol aldehyde a first solution of an ammoniacal silver nitrate and then 30 minutes subsequent to said addition, adding a solution of ammonium bromide and potassium iodide.

SUMMARY OF THE INVENTION

The present invention is directed to a method for forming photosensitive silver halide grains which comprises the steps of simultaneously introducing into an aqueous solution of gelatin and an ammonium halide, an ammoniacal solution of silver nitrate and a second solution of an ammonium halide. Thus, by means of the present invention, a double jet mode of emulsification is employed wherein ammonium ion in some form is present in each of the solutions involved in the precipitation of the silver halide grains.

DETAILED DESCRIPTION OF THE INVENTION

The novel process of the present invention is directed to a method for precipitating photosensitive silver halide grains by a double jet method wherein an ammoniacal solution of silver nitrate and a solution of ammonium halide are simultaneously disposed into an aqueous solution comprising gelatin and an ammonium halide. Thus, by means of the present invention, contrary to disclosure of the prior art, the formation of an ammoniacal photosensitive silver halide emulsion involves a double jet procedure wherein ammonia or the ammonium ion is present in each of the grain forming components.

By employing the double jet procedure, better control over the silver to halide ratios are achieved with less secondary nucleation. Thus, a narrower halide distribution can be maintained.

Preferably the silver halide grains prepared by the novel process of the present invention contain about 0.5 to 10% iodide, more preferably, 3 to 7% iodide and; in a particularly preferred embodiment, 6% iodide. Preferably the remaining halide is bromide. The method of the present invention thus provides a photosensitive silver halide grain with the core of the grain iodide rich with respect to the remainder of the grain. That is, the core contains a higher percentage of iodide with a lesser portion of iodide distributed substantially throuout the remainder of the grain.

The grains prepared by the novel process of the present invention generally range from about 0.5 to 2 microns in size. While some prior art methods can provide as narrow grain size distributions, it must be done with a relatively large quantity of ammonia which results in speed loss.

The novel process of the present invention provides photosensitive silver halide grains which possess a faster emulsion speed than prior art methods such as neutral triple jet procedures and ammoniacal halide double jet procedures. Grain size is controlled more easily in the process of the present invention.

Examples A and B, following, are illustrative of the prior art:

EXAMPLE A

The following solutions were prepared:

SOLUTION 1
- Distilled water: 983 g
- Potassium bromide: 169 g
- Potassium iodide: 10 g
- Derivatized gelatin: 12.5 g SOLUTION 2 (Repeat 3 times)
- Distilled water: 555 g
- Silver nitrate: 56.7 g Solution 1 was brought to 60° C. and then Solution 2 was added with stirring sequentially three times at 25 min. intervals. Twenty-eight minutes after the last addition of Solution 2, the temperature was lowered to 30° C. and the emulsion flocculated using sulfuric acid. The emulsion was then washed to a conductivity of below 500$\mu$ mhos/cm. The emulsion was reconstituted by adjusting the pH to 5.7 and adding inert deionized gelatin to yield a gelatin/silver ratio of $\frac{1}{2}$.

EXAMPLE B

The following solutions were prepared:

SOLUTION 1
- Distilled water: 647 g
- Ammonium bromide: 137.7 g
- Potassium iodide: 9.1 g
- Derivatized gelatin: 12.6 g SOLUTION 2
- Distilled water: 1530 g
- Silver nitrate: 170 g
- Ammonium hydroxide (30%): 137.5 g After solution 1 was raised to 48° C., Solution 2 was jetted into Solution 1 with mixing over a 30 min. period. After the addition of Solution 1, the thus-formed emulsion was held at 48° C. for 15 min. and then the temperature was lowered to 20° C. and flocculation was carried out with sulfuric acid. The thus-formed emulsion was washed until the conductivity was below 500μ mhos/cm. The emulsion was reconstituted by adjusting the pH to 5.7 and adding inert deionized gelatin to yield a gelatin/silver ratio of ½.

The following non-limiting examples illustrate the novel process of the present invention:

EXAMPLE 1

The following solutions were prepared:

SOLUTION 1
- Distilled water: 917 g
- Ammonium bromide: 48.5 g
- Ammonium iodide (1%): 42.5 g
- Potassium iodide (10%): 3.4 g
- Derivatized gelatin: 12.5 g SOLUTION 2
- Distilled water: 499 g
- Silver nitrate: 170 g
- Ammonium hydroxide (30%): 140 g SOLUTION 3
- Distilled water: 602 g
- Ammonium bromide: 98 g After Solution 1 was brought to 32° C., Solutions 2 and 3 were simultaneously jetted into Solution 1 with mixing over a 4 minute period. The emulsion temperature was lowered to 20° C. and flocculated with sulfuric acid and the emulsion washed until the conductivity was below 500μ mhos/cm. The emulsion was reconstituted by adjusting the pH to 5.7 and adding inert deionized gelatin to give a gelatin/silver ratio of ½.

EXAMPLE 2

The following solutions were prepared:

SOLUTION 1
- Distilled water: 905 g
- Ammonium bromide: 97.5 g
- Ammonium iodide (1%): 42.5 g
- Potassium iodide (10%): 3.4 g
- Derivatized gel: 12.5 g SOLUTION 2
- Distilled water: 499 g
- Silver nitrate: 170 g
- Ammonium hydroxide (30%): 140 g SOLUTION 3
- Distilled water: 602 g
- Ammonium bromide: 98 g After solution 1 was brought to 58° C., Solutions 2 and 3 were simultaneously jetted into Solution 1 with mixing over a 12 minute period. The emulsion temperature was lowered to 58° C., held at that temperature for 20 minutes and then flocculated with sulfuric acid and the emulsion washed until the conductivity was below 500μ mhos/cm. The emulsion was reconstituted by adjusting the pH to 5.7 and adding inert deionized gelatin to give a gelatin/silver ratio of ½.

EXAMPLE 3

The following solutions were prepared:

SOLUTION 1
- Distilled water: 905 g
- Ammonium bromide: 92.1 g
- Ammonium iodide (1%): 42.5 g
- Potassium iodide: 9.5 g
- Derivatized gel: 12.5 g SOLUTION 2
- Distilled water: 499 g
- Silver nitrate: 170 g
- Ammonium hydroxide (30%): 140 g SOLUTION 3
- Distilled water: 602 g
- Ammonium bromide: 98 g After Solution 1 was brought to 57° C., Solutions 2 and 3 were simultaneously jetted into Solution 1 with mixing over a 12 minute period. The emulsion temperature was held at 57° C. for 20 minutes and then lowered to 20° C. The emulstion was then flocculated with sulfuric acid and washed until the conductivity was below 500μ mhos/cm. The emulsion was reconstituted by adjusting the pH to 5.7 and adding inert deionized gelatin to give a gelatin/silver ratio of ½.

EXAMPLE 4

The following solutions were prepared:

SOLUTION 1
- Distilled water: 905 g
- Ammonium bromide: 92.1 g
- Potassium iodide: 10.0 g
- Derivatized gel: 12.5 g SOLUTION 2
- Distilled water: 499.2 g
- Silver nitrate: 170 g
- Ammonium hydroxide (30%): 140 g SOLUTION 3
- Distilled water: 602 g
- Ammonium bromide: 98 g After Solution 1 was brought to 60° C., Solutions 2 and 3 were simultaneously jetted into Solution 1 with mixing over a 18 minute period. The emulsion temperature was held at 60° C. for 20 minutes, then lowered to 20° C. and flocculated with sulfuric acid. The emulsion was washed until the conductivity was below 500μ mhos/cm. The emulsion was reconstituted by adjusting the pH to 5.7 and adding inert deionized gelatin to give a gelatin/silver ratio of ½.

EXAMPLE 5

The following solutions were prepared:

SOLUTION 1
- Distilled water: 917 g
- Ammonium bromide: 39.2
- Ammonium iodide (1%): 42.5 g
- Potassium iodide: 16.1 g
- Derivatized gelatin: 12.5 g SOLUTION 2
- Distilled water: 499 g
- Silver nitrate: 170 g
- Ammonium hydroxide (30%): 140 g SOLUTION 3
- Distilled water: 602 g
- Ammonium bromide: 98.0 g After Solution 1 was brought to 42° C., Solutions 2 and 3 were simultaneously jetted into Solution 1 with mixing over a 5 minute peiod. The emulsion temperature was lowered to 20° C. and flocculated with sulfuric acid and the emulsion washed until the conductivity was below 500μ mhos/cm. The emulsion was reconstituted by adjusting the pH to 5.7 and adding inert deionized gelatin to give a gelatin/silver ratio of ½.

EXAMPLE 6

The following solutions were prepared:

SOLUTION 1
- Distilled water: 905 g
- Ammonium bromide: 88.2 g
- Ammonium iodide (1%): 42.5 g Potassium iodide: 16.1 g
Derivatized gel: 12.5 g

SOLUTION 2

Distilled water: 499 g
Silver nitrate: 170 g
Ammonium hydroxide (30%): 140 g

SOLUTION 3

Distilled water: 602 g
Ammonium bromide: 98.2 g

After Solution 1 was brought to 65° C., Solutions 2 and 3 were simultaneously jetted into Solution 1 with mixing over an 18 minute period. The emulsion was held at 65° C. for 20 minutes and then lowered to 20° C. and flocculated with sulfuric acid. The emulsion was washed until the conductivity was below 500μ mhos/cm. The emulsion was reconstituted by adjusting the pH to 5.7 and adding inert deionized gelatin to yield a gelatin/silver ratio of ½.

Table 1 sets forth certain data relative to the above Examples, including the percent iodide of the grains, the Mean Volume Diameter and the Volume Standard Deviation.

TABLE 1

| Ex-AMPLE | % IODIDE | GRAIN SIZE (COULTER COUNT) MEAN VOLUME DIAMETER, MICRONS | Volume Standard Deviation |
|---|---|---|---|
| A | 6 | 1.50 | 0.64 |
| B | 5.5 | 1.70 | 0.54 |
| 1 | 0.5 | 0.54 | 0.27 |
| 2 | 0.5 | 1.58 | 0.38 |
| 3 | 6 | 1.51 | 0.46 |
| 4 | 5 | 1.61 | 0.47 |
| 5 | 5 | 1.54 | 0.48 |
| 5 | 10 | 0.58 | 0.30 |
| 6 | 10 | 2.05 | 0.54 |

The data of Table 1 illustrates the advantages which can be obtained by the present invention. In all Examples except one, the Standard Deviation is significantly less than that obtained with prior art methods. The relatively high value obtained in Example 6 is due to the fact that a large percentage of iodide is present as well as a large grain size.

EXAMPLE 7

The emulsion of Example 4 was chemically sensitized on a per mole of silver basis with 0.8 mg. aurochloric acid hexahydrate, 21 mg. potassium thiocyanate and 1.3 mg. sodium thiosulfate. The solution was then heated for 210 minutes. The thus formed emulsion was then pan sensitized and coated at a gelatin silver ratio of 3 to 1. Over this coating was applied a layer of mucochloric acid at a ratio of 1 to 20 based on the gelatin.

The thus formed emulsion was then exposed and processed with a Polaroid Type 107 receiving layer and processing composition at a 2 mil. gap with a 30 second imbibtion period. It was found that, compared to emulsions A and B, sensitized and processed in exactly the same manner, Example 7 showed a speed increase of about 2 and about 1 stops, respectively.

With regard to the use of chemical sensitizing agents suitable for employment in the present invention, mention may be made of U.S. Pat. Nos. 1,574,944; 1,623,499; 2,410,689; 2,597,856; 2,597,915; 2,487,850; 2,518,698; 2,521,926; and the like as well as Neblette, C. B., Photography, Its Materials and Processes, 6th Ed., 1962.

Spectral sensitization of the silver halide grains may be accomplished by contacting the grains with an effective concentration of the selected spectral sensitizing dyes dissolved in an appropriate dispersing solvent such as methanol, ethanol, acetone, water and the like; all according to the traditional procedures of the art, as described in Hamer, F. M., The Cyanine Dyes and Related Compounds, as well as the abovementioned disposition of the sensitizers of the electrolyte solution prior to or during grain formation.

Reduction sensitization of the grains prior to or subsequent to the addition of the binder may also be accomplished employing conventional materials known to the art, such as stannous chloride.

Sensitizers of the solid semiconductor type, such as lead oxide, may also be employed.

Additional optional additives, such as coating aids, hardeners, viscosity-increasing agents, stabilizers, preservatives, and the like, also may be incorporated in the emulsion formulation, according to the conventional procedures known in the photographic emulsion manufacturing art.

What is claimed is:

1. A method for forming photosensitive silver halide grains being substantially uniform in size having an average mean diameter within the range of about 0.5 to 2μ. wherein the halide content comprises at least about 0.5–10% iodide wherein the core of said grains is iodide rich with respect to the remainder of the grains, which comprises the steps of simultaneously introducing into an aqueous solution of gelatin, ammonium bromide and a water-soluble iodide salt (1) an ammoniacal solution of silver nitrate and (2) a solution of ammonium bromide or chloride.

2. The method as defined in claim 1 which includes the step of chemically sensitizing said grains.

3. The method of claim 1 wherein said water-soluble iodide salt is potassium iodide.

4. The method of claim 1 wherein the halide content of said grain comprises about 3 to 7% iodide.

5. A photosensitive silver halide emulsion prepared according to the procedure of claim 1.

6. The product of claim 5 wherein said water-soluble iodide salt is potassium iodide.

7. The product of claim 5 wherein the halide content of said grains comprises about 3 to 7% iodide.

8. The product of claim 5 wherein the surface of said grains is chemically sensitized.

9. A photosensitive element comprising a support carrying an emulsion prepared according to the procedure of claim 1.

10. The element of claim 9 wherein said water-soluble iodide salt is potassium iodide.

11. The element of claim 1 wherein the halide content of said grains comprises about 3 to 7% iodide.

12. The element of claim 9 wherein the surface of said grains is chemically sensitized.

* * * * *